United States Patent [19]

Cox

[11] 4,126,408

[45] Nov. 21, 1978

[54] LIQUID FUELED LAMP

[76] Inventor: Wayne A. Cox, 6914 Orchid La., Dallas, Tex. 75230

[21] Appl. No.: 795,939

[22] Filed: May 11, 1977

Related U.S. Application Data

[63] Continuation-in-part of Ser. No. 613,250, Sep. 15, 1975, abandoned.

[51] Int. Cl.[2] ..... F23D 3/24

[52] U.S. Cl. ..... 431/2; 431/146; 431/320; 431/325

[58] Field of Search ..... 126/45, 47; 431/146, 431/313, 325, 126, 320, 2, 3; 240/13

[56] References Cited

U.S. PATENT DOCUMENTS

| | | | |
|---|---|---|---|
| 2,120,255 | 6/1938 | McCloskey | 431/146 |
| 2,800,007 | 7/1957 | Kruizenga | 431/325 X |
| 2,912,742 | 11/1959 | Choate | 431/325 X |
| 3,799,731 | 3/1974 | Novak | 431/313 |
| 3,811,817 | 5/1974 | Mansnerns et al. | 431/126 |

FOREIGN PATENT DOCUMENTS

| | | | |
|---|---|---|---|
| 834,151 | 5/1960 | United Kingdom | 431/325 |
| 845,639 | 8/1960 | United Kingdom | 431/325 |

*Primary Examiner*—Edward G. Favors
*Attorney, Agent, or Firm*—Charles W. McHugh

[57] ABSTRACT

A liquid-fueled lamp comprising a liquid-impervious container, which is preferably a light-weight steel can of the type used to store foods, etc. A relatively small opening is provided in the top of the can, and a tube or some other structural member extends through the opening. The tube is preferably rigidly secured to the container, as by welding or brazing. A metal tube having a ¼ inch diameter is suitable. A flame-positioning means, such as a "plug" of asbestos fibers, is mounted in the top of the tube. A wick for transferring fuel from within the container to the flame-positioning means is also provided. Preferably, the wick is made of a narrow piece of double-knit polyester material. The wick and the plug of asbestos fibers are mechanically held together by the tube, so that fuel drawn upward by the wick will saturate the asbestos plug. Typically, the wick will furnish more fuel to the asbestos plug than will be consumed by a flame. Hence, a fuel-drainage means is desirable for permitting the drainage of excess fuel back into the container. The fuel-drainage means may consist of a structural trap surrounding the tube, with an aperture located in the top of the container and within the structural trap. The preferred fuel for such a lamp is mineral oil, which heretofore has been primarily used as a laxative and lubricant, and as a carrier for cosmetics and insecticides, etc. Such oil as meets National Formulary (NF) or U.S. Pharmacopia (USP) specifications for mineral oil will burn with essentially no odor. Technical grade mineral oil will also burn in the lamp described herein, but it has a faint odor that might be objectionable to some persons. The lamp is particularly safe when it is fueled with mineral oil, because—unlike kerosene and other fuel oils—mineral oil is rather hard to burn.

16 Claims, 5 Drawing Figures

LIQUID FUELED LAMP

This is a continuation-in-part of application Ser. No. 613,250 filed Sept. 15, 1975, now abandoned.

This invention relates generally to liquid-fueled lamps, and more particularly to a lamp which is adapted for the efficacious burning of a certain hydrocarbon fuel (having the nature of mineral oil) for producing light and/or heat.

No doubt it is true that before history was first recorded people were using oil-burning lamps to provide illumination; of course, whether they wanted it or not, they also got heat. As the course of life changed, certain types of fuels and specialized types of equipment began to be used for the specific purpose of fostering the output of either light or heat. With regard to the production of light, perhaps one of the more commonly employed liquid fuels has been kerosene, although other liquids such as alcohol—and even salad oil—have been proposed from time to time as suitable for a fuel. One of the deficiencies of common kerosene has been its relatively low light output in comparison to some other light sources, as well as the pronounced odor that attends its burning. Also, a kerosene-fueled device is usually always recognizable by the gentle flickering of its flame, which is not necessarily a pleasing characteristic. Still further, kerosene-fueled devices constitute an inherent fire risk, and there are many reported stories concerning tragic fires and/or accidents that have resulted from a person accidently dropping or knocking over a burning kerosene lantern.

When only a modest amount of light is desired, the risk of burning a liquid fuel like kerosene has been avoided through the use of paraffin candles. As is especially true in modern restaurants, clubs, private residences, etc., where it has been desirable to have the subtle lighting which is typically provided by a candle, such solid-fueled devices have become widely accepted. Among the more commercially successful of such devices are those that are contained within a decorative glass shell, which is quite functional in that it prevents the molten paraffin from spilling onto a table as it burns, etc. While such candles and/or paraffin-fueled devices have been widely used, it is generally acknowledged that they still are not the ultimate in low-level illumination—because of their expense and wastefulness, among other things. That is, following the complete burning of a paraffin candle that was contained in a glass, the perfectly good glass must usually be discarded, because it is impractical to try to return an empty glass to a factory for refilling. Furthermore, because of the frangible nature of the typical glass shell, a new candle may be effectively rendered unburnable if its glass becomes badly cracked or broken—unless an auxiliary bowl is provided to capture the molten wax. Hence, an otherwise serviceable quantity of solid fuel must be discarded, just because its glass container suffered damage; this is obviously wasteful. Accordingly, there has been a long-standing need for a satisfactory source of light in small quantities—other than candles—for decorative purposes, etc.

As mentioned above, the idea of using a liquid fuel is admittedly quite old, but there are many regulatory restraints of modern origin on the use of particular fuels—which restraints were not believed necessary in earlier times, and which have now brought a completely new dimension to decorative lighting. For example, in U.S. Pat. No. 1,281,077 there is disclosed an "artificial candle" which is adapted to be filled with kerosene or a similar fluid; a threaded aperture is provided in the top of this artificial candle so that a cap may be selectively removed to permit the reservoir to be refilled after the initial quantity of fuel has been burned. While such a construction may have been highly regarded several years ago, it would almost certainly never be approved for public use by modern fire departments and/or other regulatory bodies—because of the risk that some person might inadvertently refill the container with a dangerous hydrocarbon fuel (such as gasoline) rather than relatively innocuous kerosene. If such a container were to be deliberately or accidently filled with gasoline, it would then become what could be accurately described as a bomb. Hence, refillable containers are generally not favored by those agencies that are concerned with guarding the public's safety and/or preventing fires. Even when a container is only filled with kerosene, it still constitutes what is sometimes colloquially referred to as a "Molotov cocktail." Thus, solid-fueled devices (such as paraffin candles) have been more widely sold in recent years than liquid-fueled devices, even though the solid-fueled devices are generally more expensive to market.

A solution to this long-felt need for a safe and economically fueled lamp has now been found, and it involves that class of hydrocarbon liquids which are commonly referred to as mineral oil. In general, the term "mineral oil" will be used herein to refer to distillation products of crude petroleum, which products are essentially colorless, tasteless, transparent, and practically free of the fluorescence that characterizes lubricating oils. Its specific gravity will typically be between about 0.82 and 0.90; its molecular weight will range from about 280 G.M.W. to about 430 G.M.W. Its flash point will typically be in excess of 300° F. (If an attempt is made to light a pool of mineral oil in an open dish with a match or the like, such an attempt will be unsuccessful; thus, a burning match can be extinguished by dipping it into mineral oil of the type being referred to herein.) Its initial boiling will be much higher than, say, that of kerosene; an average value of 680° F. for mineral oil is reported in the Fire Protection Handbook for Hazardous Materials, 5th Edition—as compared with 304°-574° F. for kerosene and fuel oil. The auto-ignition temperature and the fire point of mineral oil are both high, which are definite "pluses" with regard to safety. It is also characterized by a relatively high purity, i.e., it will not have any significant amounts of sulfur, nitrogen, halogen derivatives, unsaturated compounds or aromatics.

Perhaps it is appropriate to mention at this time that, as employed herein, the term "mineral oil" will have a much more narrow meaning than the term sometimes has. Some authorities use the term broadly to contrast oils derived from the earth (minerals, petroleum, etc.) with those derived from animals or vegetables. And, it appears that the U.S. Patent Office uses such a broad approach in its classification system; specifically, class 208 (Mineral Oils: Processes and Products) includes a very wide range of products, including tars, pitches, asphalts, gasolines, kerosenes, waxes, jet engine fuels, bunker oils, etc. But the term "mineral oil" as used with regard to this invention is to be interpreted as referring to that class of liquids that are designated as white mineral oils according to National Formulary (NF) and U.S. Pharmacopeia (USP) specifications. Commercially available "technical" grades of mineral oils will also burn satisfactorily with the lamp described herein, although there may be a slightly objectionable odor with some brands. (No doubt the slightly different specifications of the technical grades and their permissible level of "impurities" contributes to the odor that is detectable when they are burned.) While some odor may be associated with burning technical grade mineral oil, it is certainly much less than the odor that attends the burning of kerosene; and such odor as is present would likely be noticed only in a closed room. In an outdoor area such as a patio or garden, the technical grade oils might perform quite satisfactorily.

Exemplary mineral oils that are serviceable in this invention are those which are obtainable from Chevron, Humble, Penreco, and the Sonneborn Division of WITCO Chemical Corporation. The preferred mineral oil is "Carnation White" oil marketed by Sonneborn, which is a NF grade oil. The commercially available oils are reported to be mixtures of naphthene and paraffin hydrocarbons, with compounds ranging in size from 18 to 36 carbon atoms per molecule. Usually the percentage of paraffin hydrocarbons will exceed the naphthene hydrocarbons, with a ratio of 60:40 being perhaps a fairly representative value.

To further contrast other oils with the mineral oils that are of primary interest herein, it will perhaps be instructive to point out that the mineral oils that have now been found to be such effective fuels were previously touted primarily as laxatives, salves and ointments, as well as lubricants in the food and candy-making industry, etc. Indeed, it is believed that four main industries, namely, the food, pharmaceutical, insecticide and cosmetic industries, probably accounted for almost all of the white oil or mineral oil that has been sold in recent years. It should be appreciated, then, why the successful use of mineral oil as a lamp fuel should be recognized as new use for an old product. The preferred manner of exploiting this new use will become more readily apparent from a reading of the specification and claims and from an examination of the drawing, in which:

Figure 1:
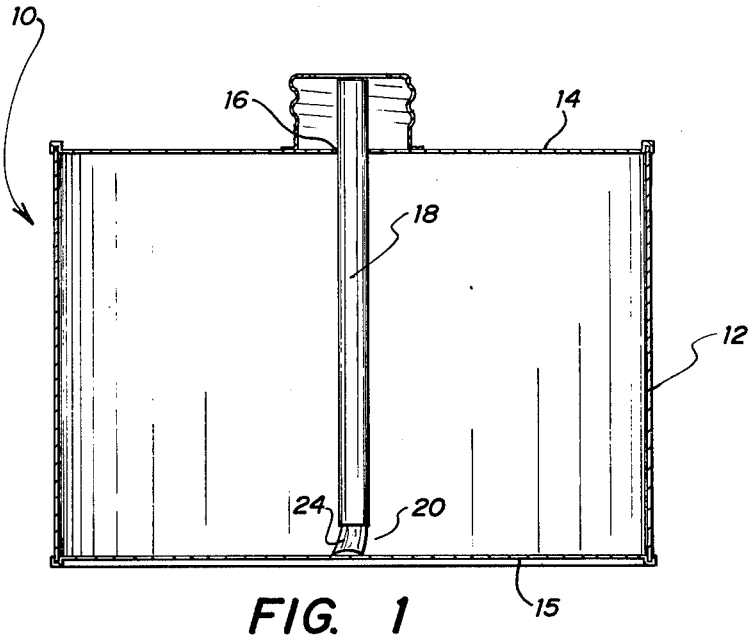
FIG. 1 is a front elevational view, in cross-section, of a lamp which is adapted to burn mineral oil.

Referring initially to FIG. 1 which shows a preferred embodiment of the invention, a liquid fuel lamp 10 includes a sealable container 12 which may be a throw-away steel can (i.e., a so-called "tin" can), and preferably is a can of the No. 2½ "family" of food cans. In order to promote convenient manufacturing of the lamp 10, it is generally preferred that the container 12 be of the type initially having a separate (but sealable) top and bottom—so that the can 12 can be filled with fuel in an inverted position and subsequently sealed by applying the bottom. The top 14 of the container 12 has an opening 16 through which a tube 18 protrudes for a given distance. Internally, the tube 18 may be relatively short, but the preferred embodiment (shown in FIG. 1) includes a tube which has a length substantially the same as the container is high. When the tube 18 and the container 12 are manufactured so as to be essentially identical in height, then a short gap 20 will exist at the bottom of the tube 18 by virtue of the top of said tube protruding upwardly beyond the top 14. This gap 20 is advantageous in that it insures that fuel will have ready access to the tube interior. The tube 18 is preferably affixed to the container top 14 by welding or the like, such that a known gap 20 will always be provided at the bottom of the tube throughout the container's useful life, to foster the entrance of fuel to the tube. Having only a short gap between the bottom of the tube 18 and the floor of the container 12 is also advantageous in that it more nearly insures consistent burning of fuel, regardless of whether the container is almost full or almost empty. That is, by requiring that all fuel that is burned be drawn up through the tube 18 for the same length, then there should be relatively little difference between burning characteristics of a nearly full container and a nearly empty one. If the tube 18 is not rigidly affixed to the container (as by welding or the like), then some sort of mechanical restraint should be put on the tube, in order that it will not become disoriented during handling or shipping so as to render the lamp less efficient.

Figure 2:
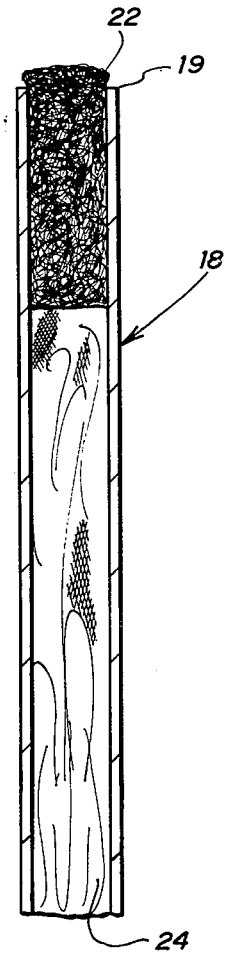
FIG. 2 is an enlarged cross-sectional view of the top portion of a tube which is shown in FIG. 1.

Referring next to FIG. 2, which is an enlarged view of the tube 18, it will be seen that the tube serves a very beneficial mechanical purpose in physically holding together two critical elements of the apparatus. These two elements are: (1) a flame-positioning means 22 for establishing a spot at which the lamp's flame is to burn; and (2) a wick means 24 for transferring fuel from the reservoir to the flame-positioning means. The preferred flame-positioning means 22 constitutes a short plug of asbestos fibers wedged in the end of the tube 18. By the term "short" it is intended to suggest a length that is not very much greater than its breadth. When the container is a No. 2½ steel can, the tube 18 should be at least ⅛ inch in diameter; a preferred tube 18 will have a diameter of about ¼ inch. In turn, the diameter of the asbestos plug 22 for a preferred tube will be about ¼ inch, and its length will typically be significantly less than ½ inch. As for the nature of the asbestos, it has been found that 500° F. asbestos rope sold by Johns-Mansville is particularly efficacious for use in this invention. Such rope having a diameter of ½ inch is widely sold to those in the piping industry for sealing pipes that may be subjected to elevated temperatures. As the rope is advanced axially past a work station, a punch or the like may be used to remove "plugs" of the twisted asbestos fibers from the rope.

The extent to which the plug 22 extends above the tube 18 will affect the size of the flame which can be realized above the plug 22, with a greater exposed portion of plug contributing to a larger flame. However, a certain amount of care should usually be exercised in manually pulling the asbestos plug too far out of the tube 18 for flame-adjustment purposes, because—in the embodiment shown in FIG. 2—the plug 22 and the wick 24 are held in fuel-transferring contact only by the surrounding tube. To join them mechanically, as by sewing or stapling, etc., would naturally add more structural reliability to their connection; but it would also add the expense of a manufacturing step that is frequently unnecessary. That is, as long as the top of the wick 24 is pushed firmly against the asbestos plug 22, and the bottom of the wick is in contact with fuel, then fuel will be drawn up into the tube by the wicking material and will be available for burning. In this regard, it is perhaps appropriate to mention here that a homogeneous asbestos wick which extends for two inches or more from the protruding end 19 of the tube 18 to near the container bottom 15 has been found to provide insufficient drawing characteristics for the preferred fuel for this lamp, namely, white mineral oil. Hence, a wicking material which is more efficient than asbestos is needed for drawing white mineral oil to any significant height, and the most efficient wicking material for such a liquid that has been discovered is a woven fabric made of double-knit polyester fiber. Such a material is derived from petroleum, and it is stable in the presence of mineral oil of the type described herein, i.e., the polyester fiber is not subject to deterioration by virtue of being immersed in mineral oil.

The aforementioned double-knit polyester wicking material 24 is particularly beneficial in the disclosed lamp for the reason that it has a capability of furnishing to the burning spot (at the tube end 19) slightly more fuel than can normally be burned. With such a construction, there will always be an adequate supply of fuel, i.e., the burning spot will never starve for fuel—which could contribute to excessive forming of carbon at (or even within) the asbestos plug. A strip of polyester double-knit material about ¼ inch wide will readily draw mineral oil to a height of at least 6 inches, which is more than adequate for a typical table-top lamp. An alternate wick material is felt.

Figure 3:
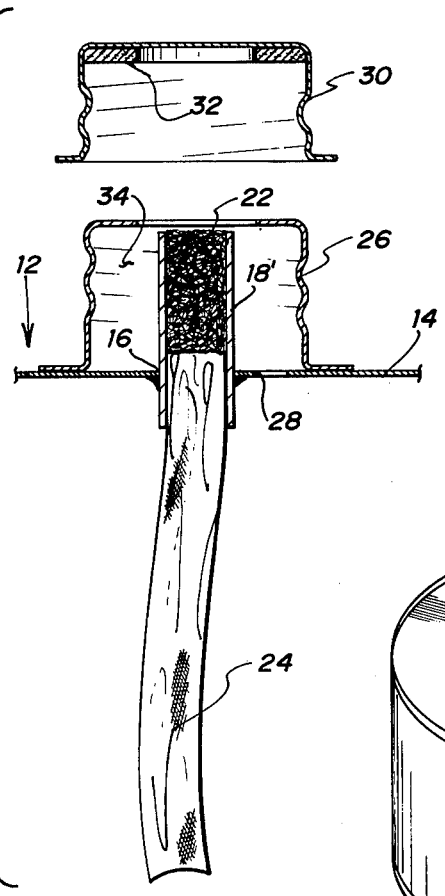
FIG. 3 is an enlarged, fragmentary, cross-sectional view of the top of a lamp in accordance with the invention.

Another way to insure that there will always be enough fuel to provide a steady flame might be to monitor and continuously adjust a control valve which supplies the fuel. Of course, such adjustment as might be necessary could only be established by providing a sophisticated sensor and a computer or similar control apparatus for modulating the flow of fuel. Alternatively, a human being could be designated to sit and watch the lamp, make independent value judgments as to the adequacy of the flame, and manually control a valve and/or pump to insure that a proper amount of fuel is supplied. In accordance with this invention, however, the need for either a sophisticated control system or a human observer is completely obviated. This is accomplished by providing two features: (1) some means for providing a slight excess of fuel at the flame-positioning device; and (2) a fuel-drainage means for permitting excess fuel (which was drawn upward by the wick but not burned) to flow back into the fuel reservoir. In this particular lamp, a fuel-drainage means can be created by placing in the top of the container 12 a structural trap of some kind around the wick opening, i.e., surrounding the tube 18. The structural trap may constitute an upstanding lip 26 as shown in FIG. 3, which lip is sealingly affixed to the top of the container. Any fuel which is delivered to the asbestos plug 22 but not burned will simply flow over the end of tube 18 where it may collect in the trough formed interiorly of wall 26. When such excess fuel has covered the bottom of the trough, any additional fuel will flow through aperture 28 downward into the interior of container 12. An appropriate size for aperture 28 is a hole which is about 1/16 inch in diameter. While a much larger aperture would no doubt increase the rate of flow back to the fuel reservoir, such a larger aperture might also increase the chances for accidentally splashing fuel out of the reservoir—if the lamp was being carried and was perhaps joustled a bit. On the other hand, if the aperture 28 were to be made significantly smaller than 1/16 inch in diameter, there is always the possibility that surface tension of the fuel might be so great as to inhibit the flow of fuel downward through such a small aperture. The aperture need not be round, and its ability to pass the fuel which is to be burned is the primary consideration in selecting a size and shape.

Figure 4:
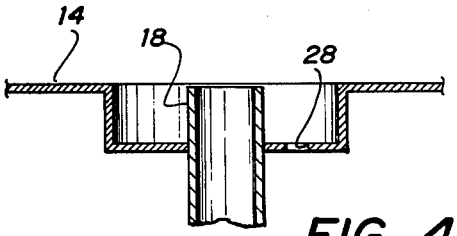
FIG. 4 is an enlarged view of an alternate embodiment of a structure for insuring the return to the reservoir of such fuel as is delivered by the wick but not burned.
Figure 5:
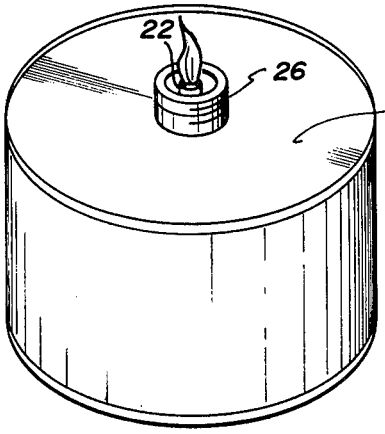
FIG. 5 is a perspective view of a lamp in accordance with the invention.

An alternate structural trap for collecting excess fuel that was not burned is shown in FIG. 4, wherein the tube 18 extends upwardly through a depression or recessed portion of the container top 14. Obviously, in order for the aperture 28 to be effective to pass excess fuel back into the reservoir, it must be near the bottom of that depression, or at least lower than the remainder of the top wall 14.

While the double-knit polyester material referred to herein has been described as a surprisingly effective wicking material, it does have at least one drawback as a wick, namely, it melts (or carbonizes) in the presence of a flame (just like nylon and other petroleum-derivative products). Hence, a wick made solely of double-knit polyester material will usually burn no more than about 10 minutes before the fuel-transfer passages in the material become blocked and incapable of passing fresh fuel to the flame. A natural sponge has also been found to be a good wicking (i.e., fuel-transferring) material, but it will soon char at the burning end if an attempt is made to light it; when it chars, it rapidly deteriorates as a drawing medium. Perhaps it will be appreciated, therefore, why a "combination wick" as disclosed herein is preferred, i.e., the combination of an optimum drawing material to initially get the fuel up to near the burning spot, and a flame-insensitive material (like asbestos) to serve as the actual flame-positioning means.

The combination of an asbestos plug at the top of a polyester wick is believed to offer one more advantage which contributes to the satisfactory burning of white mineral oil as a lamp fuel. This advantage is that the asbestos plug apparently serves as a natural regulator for the fuel supply, so that far too much fuel is not supplied—which might eventually lead to an unsatisfactory air-to-fuel ratio for the lamp. That is, with the exposed portion of the asbestos plug (i.e., the flame-positioning spot) being about 3/16 inch in diameter, and the ambient air being at atmospheric pressure and room temperature, the wicking system described herein will supply white mineral oil at about 2.7 cubic centimeters per hour through a tube that is about 3 inches long. The flame produced by this burning oil will be about ¾ inch high—with no smoking, fluttering, faltering or other offensive characteristics. The significance of this will perhaps be more fully appreciated when a person considers what may be called a "competitive" product. That is, the mineral oil lamp disclosed herein is admittedly not the only alternative to paraffin candles that has ever been suggested. And, a product known as "The UN-CANDLE" which is sold by Corning Glassworks of Corning, N.Y. has recently enjoyed some favorable consumer acceptance. The UN-CANDLE apparatus is manufactured in accordance with the teachings of U.S. Pat. No. 3,183,688 to Sobelson, and is adapted to burn vegetable oil. It is worthy of note that the instruction sheet which is furnished with the Corning "UN-CANDLE" device specifies that vegetable oil is the only fuel which should be burned in the device. And, as a cautionary note to the purchaser of an "UN-CANDLE" device, the statement is made, "Mineral oils or animal fat will cause smoking." Those purchasers who are not willing to accept the manufacturer's statement concerning use of mineral oil in an "UN-CANDLE" device can readily verify for themselves that the manufacturer is correct; an attempt to burn mineral oil in an "UN-CANDLE" will soon produce sufficient smoke as to make it abundantly clear why the caveat to burn only vegetable oil is provided. It is not known exactly why the commercially available UN-CANDLE device will not burn mineral oil in a satisfactory manner; but, of course, speculating as to the reason it won't work is not the purpose of this disclosure. Rather, this disclosure is to teach that—surprisingly—mineral oil can be burned without the offensive smoking that is reported by others.

Besides its clean, non-odorous, non-smoking burning characteristics, another significant advantage of the lamp 10 is that it ca be fabricated from relatively inexpensive materials, such that the entire lamp can be discarded without any significant economic loss after all of the fuel has been consumed. In order to provide a utilitarian (and cheap) container which has this throwaway advantage, however, there is relatively little that is added to the basic container so as to make it pretty or even attractive. When a truly decorative lamp is desired, rather than merely a lamp per se, it is preferred that an exterior decorative shell (made of colored plastic or the like) be provided to conceal the container 12 and contribute to a pleasing candle-like source of illumination. When the fuel in the lamp has been completely burned, the fuel container 12 will typically be removed from the decorative shell and discarded; a full replacement container 12 is then inserted in the decorative shell. A decorative shell for surrounding the lamp can even be made of treated paper or the like—because the lamp 10 burns rather "cool." A container cap 30, which is adapted to sealingly cover the top opening 16, would then be removed from the container 12 so as to expose the protruding end of the tube 18. As shown in FIG. 3, the container cap 30 is threaded interiorly, and the upstanding lip 26 has external threads for engagement with the container cap. A gasket or liner 32 may also be provided in the top of the container cap 30, in order to insure that any fuel which might enter the space 34 (if the container 12 should be accidentally overturned) would not be lost.

In the event that a fuel container 12 is turned over when a container top 30 is not in place, there is no safety hazard with this lamp—even if the lamp is lit. That is, with white mineral oil being used as a fuel, the lamp will not create the risk of conflagration—because the fuel itself will extinguish a flame at the burning spot 22 if a burning lamp is inverted. In other words, a pool of white mineral oil in its liquid state, and at atmospheric pressure, room temperature, etc., will not burn. This fact can be safely tested by any person through the act of pouring a quantity of mineral oil into a saucer and trying to light the same with a match; in its free-standing state, it will not burn. Naturally, if there is no risk of a conflagration when the lamp is lit, there is even less risk of a disastrous fire if the lamp is accidentally overturned when the lamp is not lit. That is, the presence of another source of flame, such as a lit cigarette or the like, poses no danger to spilled mineral oil. For these reasons, then, the lamp of this invention (with its mineral oil fuel) is characterized as being particularly safe. Indeed, it is even safer than the paraffin wax containers that are commonly used for decorative lighting in restaurants and the like. For example, if a paraffin candle was to be accidentally knocked into a patron's lap, the hot molten wax which always lies in a pool around the candle wick could cause a painful burn on the legs of that patron. Too, there is the added inconvenience of having to use special cleaning agents to remove a waxy stain from the patron's clothing. On the other hand, if a lamp of this invention was to be accidentally knocked into the lap of a restaurant patron, there would not be any hot fuel to cause a burn; and any mineral oil that spilled onto the clothing of the parton could be easily removed with soap and water.

The highly advantageous characteristics of mineral oil as a fuel, and the particularly safe characteristics of the lamp 10 would be negated, however, if a substitute fuel was placed in the lamp after the original mineral oil had been consumed. For this reason, then, it is preferred that the container 12 not be refillable by the general public. That is, by designing the lamp so that it can only be efficiently filled at the factory, a user is essentially precluded from accidentally putting in the wrong kind of fuel. Insuring that the only fuel ever burned in the lamp 10 is the original mineral oil prevents a person from subsequently filling the container with kerosene, gasoline, or other highly explosive fuels. (It is suspected that putting gasoline into the lamp 10 shown in FIG. 1 would produce a fairly decent bomb; and, for safety's sake, this is not recommended). Furthermore, those persons familiar with the engineering consideration of kerosene lamps will recognize that one reason that a substantial distance (on the order of 2 inches) is provided between the flame spot and the kerosene reservoir is to avoid overheating of the fuel in the reservoir. This separation distance is essential for kerosene lamps because the relatively low flash point of kerosene is known as 100° F., whereas the average flash point of mineal oil is listed as 380° F. (according to the Fire Protection Handbook for Hazardous Materials, Fifth Edition). Thus, the flame-positioning means for a mineral oil lamp can be practically floating on top of a pool of mineral oil—and only the concentrated, localized flame will persist. A stand-off distance of less than 1 inch can cause a localized flame to be supported at a position above a pool of mineral oil, while an attempt to do the same thing with a pool of kerosene might quickly turn the entire pool into a mass of kerosene-fed flames. It will be understood, therefore, why highly combustible fuels should be avoided in a lamp which has the exact proportions shown in FIG. 1.

If there was some way to absolutely preclude the act of re-filling the container 12 with something other than mineral oil, there is no reason why the container could not be made refillable. As with some other types of lamps, an auxiliary opening with a removable cap could be provided, so that a person might refill the lamp when it is empty. As a practical matter, however, to make the container 12 refillable by an average citizen would mean that the container would not be approved by many fire departments, safety boards, and comparable regulatory agencies. Hence, in order to be able to use the lamp in a public gathering place such as a restaurant, the user must tolerate the restriction tht the container not be refillable.

In operation of the lamp, the only requirement on the part of a user is that he be able to remove a container cap and have a match or the like, because the lamp is ready to burn as soon as a protective cap is removed, exposing the flame-positioning element 22. Indeed, were it not for concern about spilling the fuel as a result of somebody inadvertently turning a shipping carton upside down, there would really not even be any necessity for container caps. Unlike other fuels that are potentially explosive or have an offensive odor, or which might tend to evaporate if left in an unsealed container, the mineral oils employed as a fuel in this lamp are characterized by having a relatively high boiling point; and the vapor pressure curve will typically be only slightly below the boiling points. Hence, there will be much less evaporation and much less loss of fuel with mineral oil than would normally occur with conventional fuel oils.

The step of furnishing liquid fuel to the burning spot atop tube 18 is strictly passive in the embodiment of FIG. 1; that is, there is no pump or other active means for supplying fuel for burning. Too, the excess fuel (i.e., fuel which is supplied by the particularly efficient wick but not burned) is continuously and automatically diverted away from the burning spot, so that it does not interfere with optimum operation of the lamp.

Once the lamp is lit, perhaps one of the first things that a person will notice—in contrast to kerosene lamps and the like—is the absence of any offensive odor. During the typical refining and processing of mineral oils, carbonizable material is reduced to a very low value, and mineral oils are particularly noted for their lack of impurities. Hence, mineral oil can be burned in accordance with this invention with no perceptible odor and with relatively complete combustion. Furthermore, mineral oils produce more energy per volume of liquid than do fuel oils having lighter molecular weights.

During actual burning, the height of the flame above the element 22 will be found to be very stable—particularly so in comparison to the characteristic "flickering" of a kerosene lamp. That is, a typical mineral oil flame in a tranquil environment is quite steady, and there is no gulping for air or starving for fuel or other anomilies that might cause the flame to waiver or produce smoke. As for the flame height that can be expected, this will typically be a function of the size of the burning surface. An asbestos plug which is nearly flush with the end of a ½ inch metal tube will tyically produce a flame about ¾ inch high, i.e., about the same height as a typical paraffin candle. However, if a larger flame was for some reason desirable, and sufficient air was available to insure an adequate air/fuel ratio, a bit more of the asbestos plug could be exposed by withdrawing it slightly from the protruding end of the tube 18; the resulting flame would then be slightly larger. It is worthy of noting, too, that the construction shown in FIG. 2 (wherein the asbestos plug and the wick are not sewn together) may be said to have a built-in regulating factor, as far as flame height is concerned. That is, if an attempt is made to manually increase the size of the flame too much by pulling more and more asbestos out of the tube 18, eventually the asbestos plug 22 will completely separate from the wick 24 and the lamp will no longer work. This built-in flame-limiting feature is likely to be of particular interest to persons who are concerned with budgeting and the like. That is, if a restaurant manager buys lamps with the knowledge that he can expect 200 hours of burning time, but an employee could increase the flame size to the extent that the lamp would burn only 170 hours, then the manager's budget for spot illumination from lamps would be adversely affected.

At any given time the flame may be extinguished by merely blowing on it in the same manner that one extinguishes a birthday candle. The lamp may be lit, extinguished, and re-lit as many times as a person wishes, until all of the fuel has been consumed. A No. 2½ can containing about 13 fluid ounces of white mineral oil will typically burn about 200 hours with the construction shown herein. That is, with the particular asbestos material and polyester wick disclosed herein, a fuel supply rate of about 0.065 ounce of mineral oil per hour will provide a satisfactory flame of aboutt ¾ inch in height with no adverse problems such as smoking. At the conclusion of the burning period, if a person should happen to be curious and open the can (with a kitchen can opener or the like), he would discover that the can's interior is almost completely dry. In some cases the wicking material might have some fuel dampness which is detectable to a person's touch, but—in general—the lamp is particularly noteworthy for its efficiency in burning all of the fuel in the reservoir. Hence, with the construction shown in FIG. 1, there is relatively little waste and it is quite feasible to discard the entire lamp when it is empty. If the lamp 10 should be lit and allowed to burn continuously until it is empty, the aperture 28 will serve a double purpose in allowing air to enter the container 12, so that a vacuum will not be created as the fuel is burned.

While only the preferred embodiments of the invention have been disclosed in great detail herein, it will be apparent to those skilled in the art that modifications thereof can be made without departing from the spirit of the invention. Thus, the specific structures shown herein are intended to be exemplary and are not meant to be limiting, except as described in the claims appended hereto. With regard to what is encompassed by the terms "white mineral oil" or simply "mineral oil," as those terms are employed herein, attention is directed to the description of such oils in the book by Dr. Erich Meyer entitled, "White Mineral Oil and Petrolatum," published in 1968 by Chemical Publishing Company, Inc. of New York, N.Y.

What is claimed is:

1. A liquid-fueled lamp, comprising:

(a) a sealable container for liquid fuel, said container having a top opening through which a fixed tube protrudes for a given distance, and including an upstanding lip sealingly fixed to the top of the container completely around the fixed tube, and said upstanding lip having means for engagement with a container cap;

(b) a container cap which is adapted to sealingly cover the top opening and the protruding end of the tube;

(c) flame-positioning means mounted in the protruding end of the tube for establishing a spot at which the lamp's flame is to burn, with the fixed tube having a diameter of about ¼ inch, and the flame-positioning means having an exposed area that is not appreciably larger than the end opening of said tube, and said flame-positioning means constituting a short plug of asbestos fibers positioned at the top end of the tube;

(d) wick means for transferring fuel from within the container upward to the flame-positioning means, with the wick means comprising a fabic made of double-knit polyester fiber which touches the lower end of the asbestos plug; and (e) fuel-drainage means in the top of the container and located such that it permits the drainage of excess fuel back into the container, with said excess fuel constituting fuel which has been drawn upward by the wick means but which was not burned.

2. The lamp as claimed in claim 1 and further including a quantity of fuel in said container, and said fuel consisting of essentially all white mineral oil of the type commonly referred to as pharmaceutical grade, and having a specific gravity between about 0.82 and 0.90 and a flash point in excess of 300° F.

3. The lamp as claimed in claim 1 wherein the length of the wick means is about 3 inches, whereby the fuel may be drawn vertically upward for a height of about 3 inches.

4. The lamp as claimed in claim 1 wherein the asbestos fibers are compacted to a density such that the plug of fibers will pass about 0.065 ounce of white mineral oil per hour, whereby a flame height of about three-fourths inch will be established during burning of said oil.

5. The lamp as claimed in claim 1 wherein the short plug of asbestos fibers and the polyester wicking fabric are physically held together by only the fixed tube into which they are both mounted.

6. The lamp as claimed in claim 1 wherein the sealable container will hold about 13 liquid ounces of white mineral oil, and the wick means extends to the bottom of said container, whereby the lamp may burn for as long as 200 hours without being refilled.

7. A liquid-fueled lamp adapted to burn white mineral oil, comprising:

(a) a sealable container for white mineral oil and constituting a throw-away type metal can, with said container having a relatively small top opening;

(b) a tube affixed to the container and extending from a spot near the bottom of the container, through the top opening thereof, and terminating a short distance above the container;

(c) a container cap which is adapted to sealingly cover the top opening and the protruding end of the tube;

(d) flame-positioning means in the form of a small mat of asbestos fibers wedged into the protruding end of the tube, for establishing a spot at which the lamp's flame is to burn;

(e) wick means for transferring white mineral oil from within the container to the flame-positioning means, with said wick means including a strip of doubleknit polyester material lying within the tube and extending to the bottom of the container;

(f) an upstanding lip provided in the top of the container and surrounding the protruding end of the tube; and (g) a fuel-drainage aperture in the top of a container and located radially interiorly of the upstanding lip, whereby any fuel which is delivered to the flame-positioning means but which is not burned will be captured by the upstanding lip until it passes through the fuel-drainage aperture and back into the container.

8. The liquid-fueled lamp as claimed in claim 7 wherein the fuel-drainage aperture in the top of the otherwise sealed container has a diameter of about 1/16 inch, such that it is so small as to effectively preclude the refilling of the container with a new quantity of fuel, once the original quantity of mineral oil has been consumed, whereby the lamp is effectively rendered useless so that it must be thrown away after the original mineral oil has been burned.

9. The liquid-fueled lamp as claimed in claim 7, wherein the wick means and the small mat of asbestos fibers are physically held together only by the surrounding tube, such that pulling the asbestos fibers upward will tend to separate them from the polyester wicking material, and pulling them too far will completely separate the fibers from the wicking material.

10. The method of providing sustained illumination with a flame, at ambient temperature and atmospheric pressure, with no offensive odor or smoking from either the fuel itself or the burning thereof, comprising the steps of:

(a) providing a flame-positioning means in the form of a small quantity of asbestos fibers;

(b) delivering to said flame-positioning means a regulated quantity of National Formulary (NF) or U.S. Pharmacuetical (USP) white mineral oil; and (c) temporarily holding a small flame next to the flame-positioning means for a short period of time until mineral oil which is delivered to the flame-positioning means begins to burn, and the quantity of mineral oil which is delivered being appropriate to sustain a flame which is about three-fourths inch in height.

11. The method of providing sustained illumination as claimed in claim 10 wherein the mineral oil is delivered to said flame-positioning means through a wick having a length of several inches, with the wick extending into a reservoir of mineral oil, and wherein the quantity of mineral oil which is delivered to the flame-positioning means at a given time slightly exceeds the amount which is burned, with the excess fuel being returned to a reservoir for subsequent burning.

12. The method of providing sustained illumination as claimed in claim 10 including the further step of placing said flame-positioning means in communication with a reservoir of about 13 liquid ounces of said white mineral oil, with said regulated quantity of oil which is delivered to the flame-positioning means being about 0.065 ounces of oil per hour, whereby said illumination can be sustained for about 200 hours.

13. The method of providing sustained illumination as claimed in claim 10 wherein said regulated quantity of mineral oil is delivered to the flame-positioning means through capillary action in a wick, and said wick has a greater capillary capability than said asbestos fibers, whereby the ability of said asbestos fibers to accommodate the mineral oil which is delivered thereto constitutes a self-regulating property of the oil-delivery system.

14. A wicking device for drawing fuel which is to be burned from a reservoir, comprising:

(a) a tube having first and second ends;

(b) a quantity of loosely connected asbestos fibers secured in a first end of a tube, with at least some of the asbestos fibers being exposed to the air such that an air-supported flame may be established thereat; and (c) a strip of double-knit polyester material, with one end thereof being exposed at the second end of the tube where it may be wet by the fuel which is to be burned, and the other end of the strip being inside the tube and in fuel-transferring contact with the asbestos fibers.

15. The wicking device as claimed in claim 14 wherein the asbestos fibers and the strip of polyester material are physically held in fuel-transferring contact by being wedged together in the surrounding tube.

16. The wicking device as claimed in claim 14 wherein the tube has a diameter of about ¼ inch, and the asbestos fibers are concentrated in a plug which is less than ½ inch long, and the tube is about as long as the strip of polyester material.

* * * * *